US010152873B2

(12) United States Patent
Usie

(10) Patent No.: US 10,152,873 B2
(45) Date of Patent: Dec. 11, 2018

(54) ALARM VERIFICATION SYSTEM AND METHOD THEREOF

(71) Applicant: CHeKT LLC, Shreveport, LA (US)

(72) Inventor: Wesley Robert Usie, Shreveport, LA (US)

(73) Assignee: CHeKT LLC., Shreveport, LA (US)

( * ) Notice: Subject to any disclaimer, the term of this patent is extended or adjusted under 35 U.S.C. 154(b) by 0 days.

(21) Appl. No.: 15/486,624

(22) Filed: Apr. 13, 2017

(65) Prior Publication Data

US 2018/0301016 A1 Oct. 18, 2018

(51) Int. Cl.
*G08B 25/00* (2006.01)
*G08B 27/00* (2006.01)

(52) U.S. Cl.
CPC ..... *G08B 25/001* (2013.01); *G08B 27/001* (2013.01)

(58) Field of Classification Search
CPC .... G08B 25/00; G08B 25/001; G08B 25/002; G08B 25/004; G08B 25/10; G08B 25/005; G08B 25/006; G08B 25/009; G08B 25/014; G08B 25/12; G08B 25/14; G08B 26/00; G08B 26/001; G08B 26/002; G08B 26/003; G08B 26/004; G08B 26/005; G08B 26/007; G08B 26/008; G08B 27/00; G08B 27/001; G08B 27/003; G08B 27/005; G08B 27/006; G08B 29/00; G08B 29/02; G08B 29/16; G08B 29/18; G08B 29/185; G08B 29/188; A61M 16/0051
See application file for complete search history.

(56) References Cited

U.S. PATENT DOCUMENTS

| | | | | |
|---|---|---|---|---|
| 7,956,735 | B2 * | 6/2011 | Jackson | G08B 13/19656 340/3.1 |
| 8,675,071 | B1 * | 3/2014 | Slavin | H04M 11/04 348/143 |
| 8,692,665 | B2 * | 4/2014 | Hicks, III | H04L 69/14 340/10.1 |
| 8,804,997 | B2 * | 8/2014 | Gagvani | G06T 7/254 382/100 |
| 9,472,090 | B2 * | 10/2016 | Sager | H04Q 9/00 |
| 9,547,963 | B1 * | 1/2017 | Trundle | G08B 25/08 |
| 9,646,486 | B1 * | 5/2017 | Trundle | G08B 25/001 |
| 2006/0053181 | A1 * | 3/2006 | Anand | G06F 11/0715 |

(Continued)

*Primary Examiner* — Fekadeselassie Girma
(74) *Attorney, Agent, or Firm* — Heedong Chae; Lucem, PC

(57) ABSTRACT

Provided are an alarm verification system and a method thereof. According to the present invention, when occurrence of an emergency situation such as a crime or a fire is uncertain when a predetermined alarm is generated, a verification request message is transmitted to an emergency contact network which is registered in advance and, when information on the occurrence of an emergency situation is included in a response message thereof, information on the occurrence of an emergency situation is provided to a server of a police station, a hospital, a fire station, or the like, which is registered in advance so that it is possible to avoid payment of penalty for erroneously reporting for occurrence of an emergency situation, perform prompt action in response to the occurrence of the emergency situation, improve convenience in use, and improve reliability of the entire system.

13 Claims, 4 Drawing Sheets

(56) References Cited

U.S. PATENT DOCUMENTS

| | | | | |
|---|---|---|---|---|
| 2008/0143548 | A1* | 6/2008 | Grimmelmann | G08B 25/004 340/691.5 |
| 2013/0157571 | A1* | 6/2013 | Wondka | H04W 52/0245 455/41.2 |
| 2014/0006131 | A1* | 1/2014 | Causey | G06Q 10/0875 705/14.24 |
| 2014/0320648 | A1* | 10/2014 | Sager | H04Q 9/00 348/143 |
| 2016/0105847 | A1* | 4/2016 | Smith | H04L 67/125 370/252 |
| 2016/0300465 | A1* | 10/2016 | Britton | G08B 13/19682 |
| 2017/0162023 | A1* | 6/2017 | Hunter | G08B 21/12 |
| 2017/0182277 | A1* | 6/2017 | Niklewski | A61M 16/0051 |

* cited by examiner

ALARM VERIFICATION SYSTEM AND METHOD THEREOF

BACKGROUND OF THE INVENTION

1. Field of the Invention

The present invention relates to an alarm verification system and a method thereof, and more particularly, to an alarm verification system and a method thereof which, when occurrence of an emergency situation such as occurrence of a crime or a fire is uncertain when a predetermined alarm is generated, transmit a verification request message to an emergency contact network which is registered in advance and, when information on the occurrence of an emergency situation is included in a response message thereof, provide information on the occurrence of an emergency situation to a server of a police station, a hospital, a fire station, or the like, which is registered in advance.

2. Description of the Related Art

A security company server checks whether a crime occurs in a specific area through a plurality of cameras and sensors and reports the emergency situation to a server of a police station when the crime occurs.

However, when the security company server is not sure whether a crime has occurred from information obtained through the plurality of cameras and sensors, an appropriate action may not be taken or additional damages may be caused due to delay in taking an appropriate action.

SUMMARY OF THE INVENTION

An object of the present invention is to provide an alarm verification system and a method thereof which, when occurrence of an emergency situation such as occurrence of a crime or occurrence of a fire is uncertain based on information relating to a predetermined alarm which is generated, transmit a verification request message to an emergency contact network which is registered in advance and provide, when information on occurrence of an emergency situation is included in a response message thereof, information on occurrence of an emergency situation to a server of a police station, a hospital, a fire station, or the like, which is registered in advance.

Another object of the present invention is to provide an alarm verification system and a method thereof which, when a response message is not transmitted from one or more contact numbers included in an emergency contact network in response to a verification request message which is transmitted to the emergency contact network, provide information on occurrence of a crime, occurrence of a patient, occurrence of a fire, or the like to a server of a police station, a hospital, a fire station, or the like which is registered in advance, according to a predetermined coping plan.

Still another object of the present invention is to provide an alarm verification system and a method thereof which manage an activity log including a verification request message which is transmitted to an emergency contact network when an emergency situation occurs, information on whether a response message thereof is received, and time information.

According to an aspect of the present invention, an alarm verification method for ensuring reliability for an alarm includes: transmitting a verification request message, by a communication unit, to one or more terminals corresponding to one or more emergency contacts included in an emergency contact network which is registered in advance, if it is not accurately determined by means of a control unit whether it is an emergency situation based on at least one of image information obtained by a photographing unit and sensing information sensed by a sensor unit when a predetermined alarm is generated; checking whether at least one response message is received from at least one terminal among the one or more terminals within a predetermined time after transmitting the verification request message to the one or more terminals, by means of the control unit; and performing a function corresponding to response information included in the received at least one response message, by means of the control unit, when the at least one response message transmitted from the at least one terminal among one or more terminals is received by the control unit within the predetermined time, after transmitting the verification request message to the one or more terminals.

Further, according to the present invention, the verification request message may include at least one of a predetermined number of snap shots before and/or after occurrence of the emergency situation with respect to an emergency situation occurrence time related to the emergency situation, the emergency situation occurrence time information, address link information for checking a real-time image, real-time verification status information from the one or more emergency contacts included in the emergency contact network, a response field, and information on remaining time to response.

Further, according to the present invention, the method may further include: providing information on occurrence of the emergency situation to a server which is registered in advance in accordance with a predetermined coping plan, by means of the control unit, when the at least one response message transmitted from at least one terminal among the one or more terminals is not received within the predetermined time after transmitting the verification request message to the one or more terminals as the checking result; generating a first activity log related to occurrence of the emergency situation, by means of the control unit; and storing the generated first activity log in a storage unit, by means of the control unit.

Further, according to the present invention, the first activity log may include at least one of a predetermined number of snap shots before and/or after occurrence of the emergency situation with respect to an emergency situation occurrence time related to the emergency situation, a moving image for a predetermined time, an emergency situation occurrence time information, a verification request message transmitting time information, a verification request message receiving time information for each of the one or more terminals corresponding to the emergency contact, information for each of the one or more terminals indicating whether the response message is transmitted from each of the one or more terminals, and an emergency situation occurrence reporting time information.

Further, according to the present invention, the performing of the function corresponding to the response information, may include: determining whether information indicating that it is an emergency situation is included in the received at least one response message; providing information on occurrence of the emergency situation to a server which is registered in advance in accordance with a predetermined coping plan, when information indicating that it is an emergency situation is included in the received at least one response message as a determination result; ending the process without proceeding an additional procedure, when information indicating that it is not an emergency situation is included in all of the received at least one response message as the determination result; generating a second activity log related to the occurrence of the emergency situation; and storing the generated second activity log in the storage unit.

Further, according to the present invention, the second activity log may include at least one of the predetermined number of snap shots before and/or after the occurrence of the emergency situation with respect to the emergency situation occurrence time related to the emergency situation, the moving image for a predetermined time, the emergency situation occurrence time information, the verification request message transmitting time information, the verification request message receiving time information for each of the one or more terminals corresponding to the emergency contact, the information for each of the one or more terminals indicating whether the response message is transmitted from each of the one or more terminals, the response message from each of the one or more terminals, reception time information of the response message which is transmitted from each of the one or more terminals, and the emergency situation occurrence reporting time information.

Further, according to the present invention, the method may further include: checking whether the predetermined alarm is generated based on at least one information among the image information obtained by the photographing unit and the sensing information sensed by the sensor unit, by means of the control unit; determining whether at least one emergency situation among a crime, a patient, and a fire occurs, by means of the control unit, when the predetermined alarm is generated; providing information on occurrence of the emergency situation to a server which is registered in advance, by means of the control unit when it is determined that the emergency situation occurs; generating a third activity log related to the occurrence of the emergency situation, by means of the control unit; and storing the generated third activity log in the storage unit, by means of the control unit.

Further, according to the present invention, the third activity log may include at least one of a predetermined number of snap shots before and/or after the occurrence of the emergency situation with respect to the emergency situation occurrence time related to the emergency situation, a moving image for a predetermined time, an emergency situation occurrence time information, and an emergency situation occurrence reporting time information.

According to an aspect of the present invention, an alarm verification system for ensuring reliability for an alarm includes a photographing unit which obtains image information; a sensor unit which senses a motion of an object and an on/off state of a door; a communication unit which, if it is not accurately determined whether it is an emergency situation based on at least one of image information obtained by the photographing unit and sensing information sensed by the sensor unit when a predetermined alarm is generated, transmits a verification request message to one or more terminals corresponding to one or more emergency contacts included in an emergency contact network which is registered in advance; and a control unit which, when at least one response message transmitted from at least one terminal among the one or more terminals is received within a predetermined time after transmitting the verification request message to the one or more terminals, performs a function corresponding to response information included in the received at least one response message.

Further, according to the present invention, the control unit may provide information on occurrence of the emergency situation to a server which is registered in advance in accordance with a predetermined coping plan, when information indicating that it is an emergency situation is included in the received at least one response message, generates a second activity log related to the occurrence of the emergency situation, and stores the generated second activity log in a storage unit.

According to the present invention, when occurrence of an emergency situation such as occurrence of a crime or a fire is uncertain based on information relating to a predetermined alarm which is generated, a verification request message is transmitted to an emergency contact network which is registered in advance and, when information on occurrence of an emergency situation is included in a response message thereof, information on occurrence of an emergency situation is provided to a server of a police station, a hospital, a fire station, or the like, which is registered in advance so that payment of penalty for an erroneous report for occurrence of an emergency situation may be avoided.

Further, according to the present invention, when a response message is not transmitted from one or more contact numbers included in an emergency contact network in response to a verification request message which is transmitted to the one or more contact numbers, information on occurrence of a crime, occurrence of a patient, occurrence of a fire, or the like is provided to a server of a police station, a hospital, a fire station, or the like which is registered in advance, according to a predetermined coping plan, so that it is possible to perform prompt action in response to the occurrence of an emergency situation, improve convenience in use, and improve reliability of the entire system.

Further, according to the present invention, when an emergency situation occurs, an activity log including a verification request message which is transmitted to an emergency contact network, information on whether a response message thereof is received, and time information is managed so that it is possible to clarify responsibility according to a report for occurrence of an emergency situation.

DETAILED DESCRIPTION OF THE INVENTION

Figure 1:
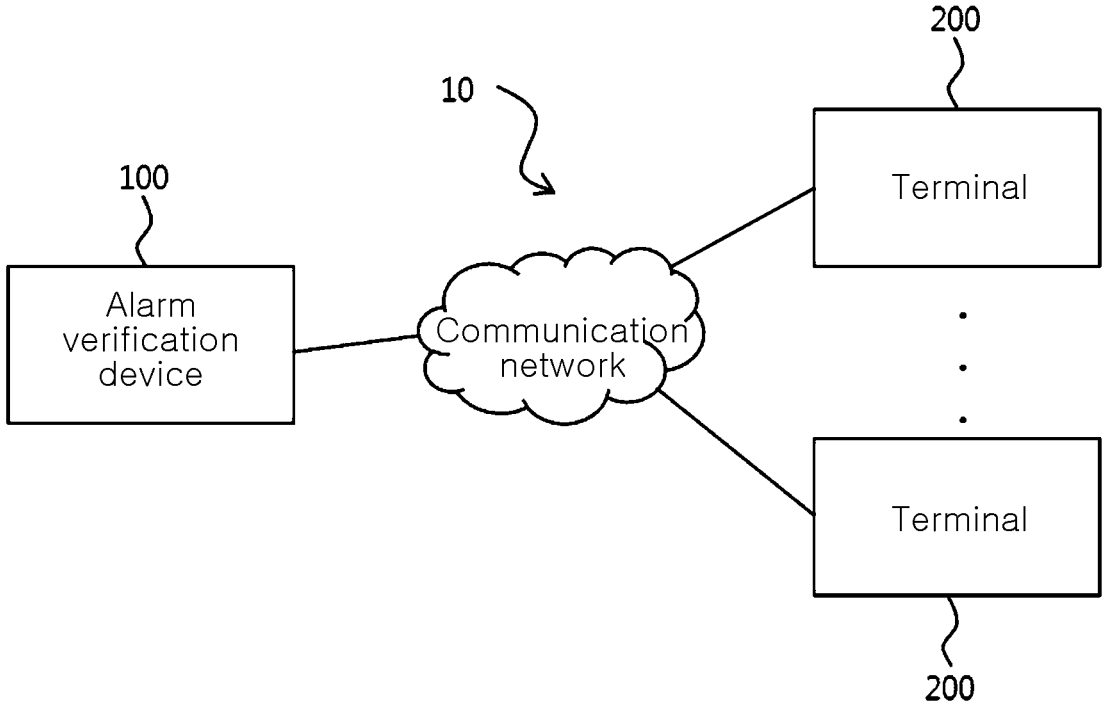
FIG. 1 is a block diagram illustrating a configuration of an alarm verification system according to an exemplary embodiment of the present invention.

It should be noted that technical terminologies used in the present invention are used to describe a specific exemplary embodiment but are not intended to limit the present invention. Further, the technical terminologies which are used in the present invention should be interpreted to have meanings that are generally understood by those with ordinary skill in the art to which the present invention pertains, unless specifically defined to have different meanings in the present invention, but not be interpreted as an excessively comprehensive meaning or an excessively restricted meaning. Further, if a technical terminology used in the present invention is an incorrect technical terminology which does not precisely describe the spirit of the present invention, the technical terminology should be replaced with and understood as a technical terminology which maybe correctly understood by those skilled in the art. Further, a general terminology used in the present invention should be interpreted as defined in a dictionary or in accordance with the context, but not be interpreted as an excessively restricted meaning.

Further, a singular form used in the present invention may include a plural form unless it has a clearly opposite meaning in the context. Terminologies such as "be configured by" or "include" in the present invention should not be interpreted to necessarily include all of plural components or plural steps described in the present invention, but should be interpreted not to include some of the components or steps or to further include additional components or steps.

Further, terminologies including an ordinal number such as first or second which is used in the present invention may be used to explain components, but the components are not limited by the terminologies. The terms are used only for distinguishing one component from another component. For example, a first component may be named a second component and similarly, the second component may also be named the first component, without departing from the scope of the present invention.

Hereinafter, exemplary embodiments according to the present invention will be described in detail with reference to the accompanying drawings, and the same or similar constituent elements are denoted by the same reference numerals regardless of a sign of the drawing, and repeated description thereof will be omitted.

Further, in describing the present invention, when it is determined that a detailed description of related well-known technology may obscure the gist of the present invention, the detailed description thereof will be omitted. Further, it should be noted that the accompanying drawings are used just for easily appreciating the spirit of the present disclosure and it should not be interpreted that the spirit of the present disclosure is limited by the accompanying drawings.

FIG. 1 is a block diagram illustrating a configuration of an alarm verification system 10 according to an exemplary embodiment of the present invention.

As illustrated in FIG. 1, the alarm verification system 10 is configured by an alarm verification device 100 and one or more terminals 200. However, all the components of the alarm verification system 10 illustrated in FIG. 1 are not essential components, but the alarm verification system 10 may be implemented by more components or less components than the components illustrated in FIG. 1.

Figure 2:
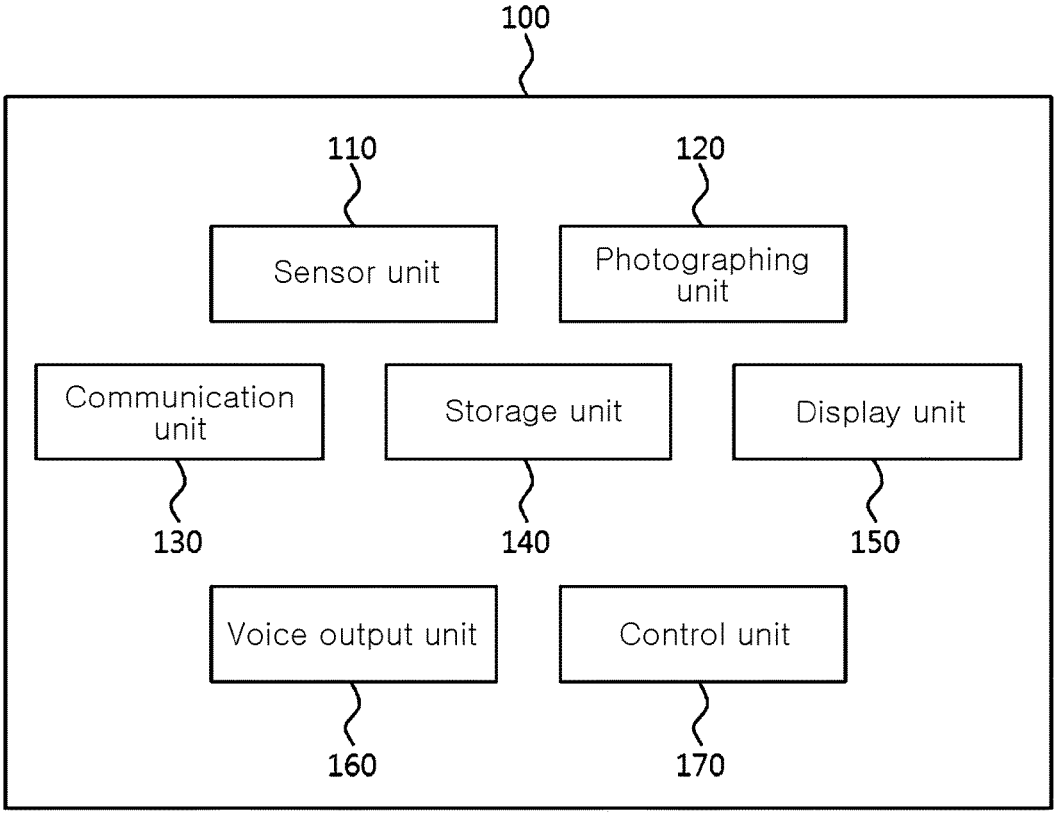
FIG. 2 is a block diagram illustrating a configuration of an alarm verification device according to an exemplary embodiment of the present invention.

As illustrated in FIG. 2, the alarm verification device 100 is configured by a sensor unit 110, a photographing unit 120, a communication unit 130, a storage unit 140, a display unit 150, a voice output unit 160, and a control unit 170. All the components of the alarm verification device 100 illustrated in FIG. 2 are not essential components, but the alarm verification device 100 may be implemented by more components or less components than the components illustrated in FIG. 2.

The sensor unit 110 includes a various types of sensors which sense an on/off state of a door and sense a motion of an object (or person) in a specific space/area.

Further, the sensor unit 110 creates sensing information according to the on/off state of the door, sensing of a motion of the object (or person) in the specific space/area, and the like.

The photographing unit 120 may be an IP camera/IP encoder a network camera, or the like.

Further, the photographing unit 120 processes an image frame such as a still image or a moving image which is obtained by an image sensor (a camera module or a camera). That is, the photographing unit 120 encodes/decodes corresponding image data obtained by the image sensor in accordance with a CODEC in accordance with a standard. The processed image frame may be displayed on the display unit 150 by the control of the control unit 170. For example, the photographing unit 120 photographs the object (or a subject) in a provided area and outputs a video signal corresponding to the photographed image (a subject image).

As described above, the photographing unit 120 obtains (or photographs) image information for an area (or a region) where the photographing unit 120 is provided.

The communication unit 130 communicates with arbitrary internal components or at least one arbitrary external terminal via a wired/wireless communication network. In this case, the arbitrary external terminal may include the terminal 200 and a server (or a center) which is not illustrated.

Further, the communication unit 130 transmits a verification request message to one or more terminals 200 corresponding to an emergency contact network which is registered in advance in the storage unit 140 by the control of the control unit 170.

The storage unit 140 stores various user interfaces UI and graphic user interfaces GUI.

Further, the storage unit 140 stores data and programs required to operate the alarm verification device 100.

That is, the storage unit 140 may store a plurality of application programs (or applications) which are driven in the alarm verification device 100 and data and commands for operation of the alarm verification device 100. At least some of the application programs may be downloaded from an external server through wireless communication. In the meantime, the application program is stored in the storage unit 140 and installed in the alarm verification device 100 to be driven to perform an operation (or a function) of the alarm verification device 100 by the control unit 170.

Further, the storage unit 140 stores sensing information sensed by the sensor unit 110 and image information obtained by the photographing unit 120 by the control of the control unit 170.

The display device 150 may display various contents such as various menu screens using the user interface and/or graphic user interface stored in the storage unit 140, by the control of the control unit 170. Here, the contents displayed on the display unit 150 may include a menu screen including various texts or image data (including various information data), and data such as icons, list menus, or a combo boxes. Further, the display unit 150 may be a touch screen.

Further, the display unit 150 may include at least one of a liquid crystal display (LCD), a thin film transistor liquid crystal display (TFT LCD), an organic light emitting diode (OLED), a flexible display, a three dimensional display (3D display), an e-ink display, and a light emitting diode (LED).

Further, the display unit 150 displays sensing information sensed by the sensor unit 110 and image information obtained by the photographing unit 120 by the control of the control unit 170.

The voice output unit 160 outputs voice information included in a signal processed by the control unit 170. Here, the voice output unit 160 may include a receiver, a speaker, a buzzer, and the like.

Further, the voice output unit 160 outputs a guidance voice generated by the control unit 170.

Further, the voice output unit 160 outputs voice information corresponding to the sensing information sensed by the sensor unit 110 and the image information obtained by the photographing unit 120 by the control of the control unit 170.

The control unit 170 performs an overall control function of the alarm verification device 100.

Further, the control unit 170 performs an overall control function of the alarm verification device 100 using a program and data stored in the storage unit 140. The control unit 170 may include a RAM, a ROM, a CPU, a GPU, and a bus and the RAM, the ROM, the CPU, the GPU, and the like are connected to each other through the bus. The CPU accesses the storage unit 140 to perform booting using an O/S stored in the storage unit 140 and performs various operations using various programs, contents, and data stored in the storage unit 140.

Further, the control unit 170 checks whether a motion of an object (or person) is sensed in the image photographed by the photographing unit 120, whether an intruder is sensed in the image, or whether an on/off state of the door is sensed according to sensing information sensed by the sensor unit 110 based on information collected by the sensor unit 110 and the photographing unit 120 and checks whether a predetermined alarm is generated.

As a checking result, when the predetermined alarm is not generated, the control unit 170 repeatedly performs the previous process of checking whether the alarm is generated.

Further, as the checking result, when the predetermined alarm is generated, the control unit 170 determines whether an emergency situation such as a crime, a patient, or a fire occurs. In this case, when the alarm is generated, the control unit 170 displays the image photographed by the photographing unit 120 and/or the sensing information sensed by the sensor unit 110 on the display unit 150 and receives an input value indicating whether the emergency situation occurs after the confirmation of an operator, based on the image displayed on the display unit 150 and/or sensing information.

As a determination result, when it is determined that it is an occurrence of an emergency situation, the control unit 170 provides information on the occurrence of the emergency situation (or an emergency situation occurrence information) to a server (not illustrated) of a police station, a hospital, a fire station, or the like which is registered in advance in the storage unit 140 through the communication unit 130.

Further, the control unit 170 generates an activity log (or activity log information) related to the occurrence of the emergency situation and stores (or manages) the generated activity log in the storage unit 140. Here, the activity log includes a predetermined number of snap shots before and/or after occurrence of the corresponding emergency situation with respect to an emergency situation occurrence time related to the emergency situation or a moving image for a predetermined time, emergency situation occurrence time information, and emergency situation occurrence reporting time information. In this case, the activity log may flexibly change depending on a situation at the time of storage.

Further, as the determination result, when it is not properly determined whether the emergency situation occurs (or when it is not accurately determined whether it is an emergency situation/it is not 100% confirmed whether it is an emergency situation by analysis of the image and/or analysis of the sensing information), the control unit 170 transmits the verification request message to one or more terminals 200 corresponding to one or more emergency contacts included in the emergency contact network which is registered in advance in the storage unit 140 through the communication unit 130. Here, the verification request message is a message for inquiring which actions should be taken on the occurred emergency situation. The verification request message includes a predetermined number of snap shots before and/or after occurrence of the corresponding emergency situation with respect to an emergency situation occurrence time related to the emergency situation, emergency situation occurrence time information, address link information for checking a real-time image, real-time verification status information from the one or more emergency contacts included in the emergency contact network, a response field, and information on remaining time to response. Further, the verification request message may have a format identified through a specific application provided from the alarm verification device 100 or may be a text message type or an e-mail type.

Further, in order to smoothly perform a subsequent action for the occurred emergency situation, the control unit 170 checks whether a response message transmitted from at least one terminal 200 among the one or more terminals 200 is received through the communication unit 130 within a predetermined time after transmitting the verification request message to the one or more terminals 200.

As a checking result, when the response message transmitted from at least one terminal 200 among the one or more terminals 200 is not received through the communication unit 130 within the predetermined time after transmitting the verification request message to the one or more terminals 200, the control unit 170 provides information on occurrence of the emergency situation to the server which is registered in advance through the communication unit 130 according to a predetermined coping plan set in advance in the storage unit 140.

Further, the control unit 170 generates an activity log (or activity log information) related to the occurrence of the emergency situation and stores (or manages) the generated activity log in the storage unit 140. Here, the activity log includes a predetermined number of snap shots before and/or after occurrence of the corresponding emergency situation with respect to an emergency situation occurrence time related to the emergency situation or a moving image for a predetermined time, emergency situation occurrence time information, verification request message transmitting time information, verification request message receiving time information for each of the one or more terminals corresponding to the emergency contact, information for each of the one or more terminals indicating whether the response message is transmitted from each of the one or more terminals, or emergency situation occurrence reporting time information.

Further, as the checking result, when the response message (or at least one response message) transmitted from at least one terminal 200 among the one or more terminals 200 is received through the communication unit 130 within a predetermined time after transmitting the verification request message to the one or more terminals 200, the control unit 170 performs a function corresponding to the response information included in the at least one received response message.

That is, when information indicating the emergency situation is included in the at least one received response message, the control unit 170 provides the information on occurrence of the emergency situation to the server which is registered in advance according to a coping plan set in advance in the storage unit 140 through the communication unit 130.

Further, the control unit 170 generates an activity log (or activity log information) related to the occurrence of the emergency situation and stores (or manages) the generated activity log. Here, the activity log includes a predetermined number of snap shots before and/or after occurrence of the emergency situation with respect to an emergency situation occurrence time related to the emergency situation, a moving image for a predetermined time, emergency situation occurrence time information, verification request message transmitting time information, verification request message receiving time information for each of the one or more terminals corresponding to the emergency contact, information for each of the one or more terminals indicating whether the response message is transmitted from each of the one or more terminals, the response message from each of the one or more terminals, reception time information of the response message which is transmitted from each of the one or more terminals, or emergency situation occurrence reporting time information.

Further, when all the at least one received response message includes information indicating that it is not emergency situation (or the at least one received response message does not include information indicating that it is an emergency situation), the control unit 170 generates the activity log (or the activity log information) and stores (or manages) the generated activity log without proceeding an additional procedure.

As described above, when the alarm is generated, the control unit 170 manages an activity log for various functions performed thereby and clarify who is responsible for transmitting the emergency situation occurrence information to the server based on the activity log later.

Further, as described above, when the alarm is generated, the control unit 170 performs a verification process on whether the alarm is true or false to ensure the reliability of the alarm.

The terminal 200 may be any one of various terminals such as a smart phone, a portable terminal, a mobile terminal, a personal digital assistant (PDA), a portable multimedia player (PMP) terminal, a telematics terminal, a navigation terminal, a personal computer, a notebook computer, a slate PC, a tablet PC, an ultrabook, a wearable device (for example, including a smart watch, a smart glass, or a head mounted display (HMD)), a Wibro terminal, an internet protocol television (IPTV) terminal, a smart TV, a digital broadcasting terminal, a television, a 3D television, a home theater system, an audio video navigation (AVN) terminal, an audio/video (A/V) system, and a flexible terminal.

Further, the terminal 200 may be a terminal corresponding to one or more contacts included in the emergency contact network.

Further, the terminal 200 receives the verification request message transmitted from the alarm verification device 100.

Further, the terminal 200 displays the received verification request message. In this case, when a specific application provided from the alarm verification device 100 is installed in advance in the terminal 200, the terminal 200 may display the verification request message through the specific application. Further, when the specific application is not installed in the terminal 200, the terminal 200 may display the verification request message which is provided as a text message (or a push message) or an email.

Further, the terminal 200 transmits the response message to the alarm verification device 100 in response to the received verification request message. Here, the response message includes response information indicating whether it is an emergency situation (for example, including a crime/crime occurrence, occurrence of a patient, a fire/fire occurrence, not crime/crime does not occur, a patient does not occur, not fire/fire does not occur). Here, only when the response message which is transmitted from the terminal 200 to the alarm verification device 100 is transmitted to the alarm verification device 100 within a predetermined time, the response message is considered as a valid message. The terminal 200 may not transmit the response message to the alarm verification device 100.

As described above, when occurrence of an emergency situation such as occurrence of a crime or a fire is uncertain based on information relating to a predetermined alarm which is generated, a verification request message is transmitted to an emergency contact network which is registered in advance and when information on occurrence of an emergency situation is included in a response message thereof, information on occurrence of an emergency situation is provided to a server of a police station, a hospital, a fire station, or the like which is registered in advance.

Further, as described above, when a response message is not transmitted from the one or more contacts included in the emergency contact network in response to the verification request message which is transmitted to the emergency contact network, information on occurrence of a crime, occurrence of a patient, occurrence of a fire, or the like may be provided to a server which is registered in advance in accordance with a predetermined coping plan.

Further, as described above, when the emergency situation occurs, the activity log including the verification request message transmitted to the emergency contact network, information on whether the response message is received, and time information may be managed.

Hereinafter, an alarm verification method according to an exemplary embodiment of the present invention will be described in detail with reference to FIGS. 1 to 4.

Figure 3:
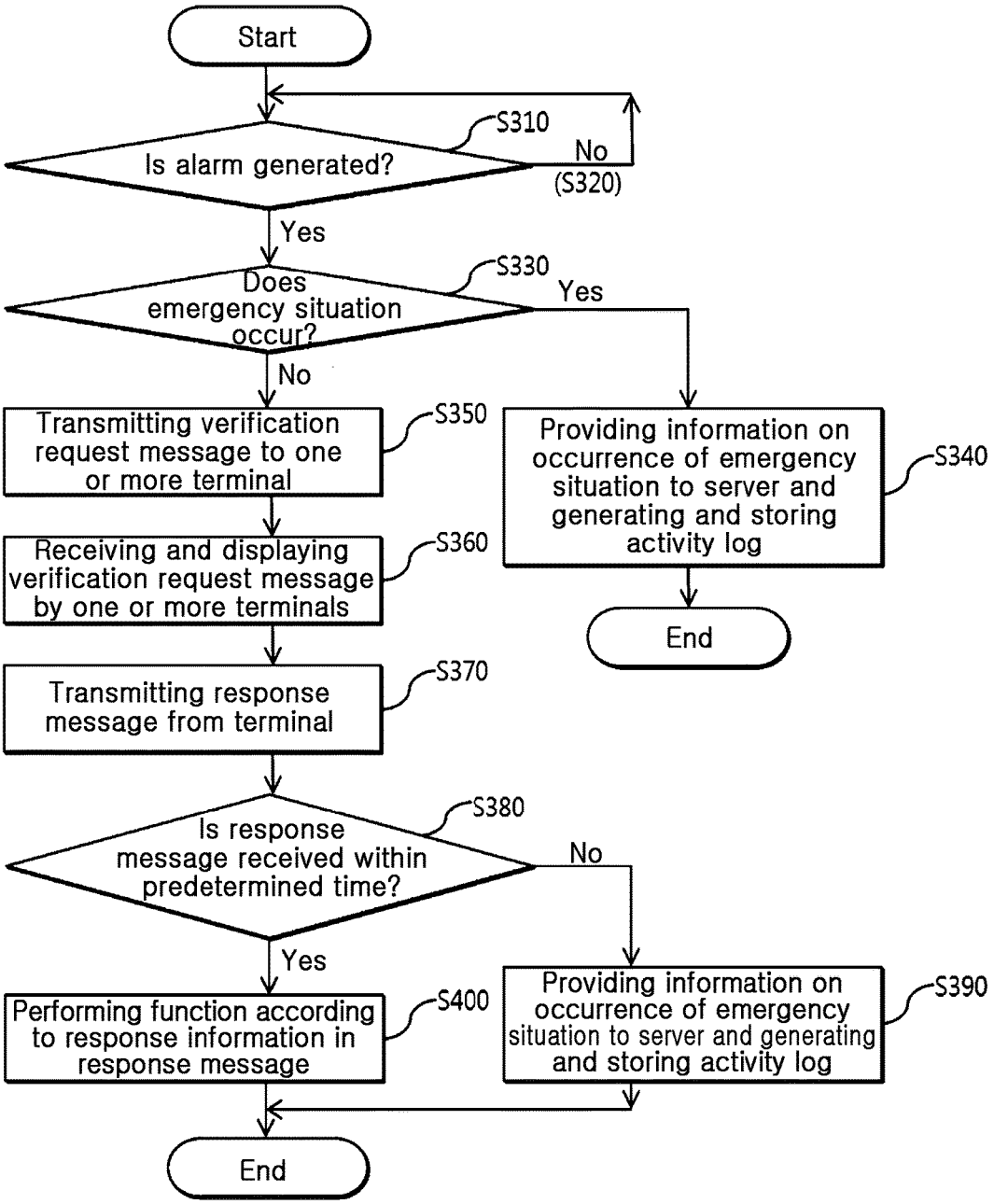
FIG. 3 is a flowchart illustrating an alarm verification method according to an exemplary embodiment of the present invention.

FIG. 3 is a flowchart illustrating an alarm verification method according to an exemplary embodiment of the present invention.

First, the alarm verification device 100 checks whether a predetermined alarm occurs.

That is, the alarm verification device 100 checks whether a motion of an object (or person) is sensed in the image photographed by the photographing unit 120, whether an intruder is sensed in the image, or whether an on/off state of the door is sensed according to sensing information sensed by the sensor unit 110 based on information collected by the sensor unit 110 and the photographing unit 120 included in the alarm verification device 100 to check whether a predetermined alarm is generated.

As an example, the alarm verification device 100 checks whether a motion of a person (or an object) is sensed in a first image which is photographed by the photographing unit 120 installed in a first shop in a remote location (S310).

As a checking result, when the predetermined alarm is not generated, the alarm verification device 100 repeatedly performs the process of checking whether the alarm is generated.

As an example, as the checking result, when the motion of the person is not sensed in the first image, the alarm verification device 100 repeatedly performs the process (S310) of checking whether a motion of a person is sensed in the first image which is consistently photographed by the photographing unit 120 installed in the first shop (S320).

Further, as the checking result, when the predetermined alarm is generated, the alarm verification device 100 determines whether an emergency situation such as a crime, a patient, or a fire occurs.

That is, as the checking result, when the predetermined alarm is generated, the alarm verification device 100 determines whether an emergency situation such as a crime, a patient, or a fire, which is registered in advance in the alarm verification device 100, occurs by analyzing the image photographed by the photographing unit 120 or analyzing sensing information sensed by the sensor unit 110.

For example, as the checking result, when the motion of a person is sensed in the first image, the alarm verification device 100 analyzes the motion of the person in the first image and determines whether the crime occurs based on the analysis result of the motion of the person in the first image (S330).

As the determination result, when it is determined that emergency situation occurs, the alarm verification device 100 provides information on occurrence of the emergency situation (or emergency situation occurrence information) to a server (not illustrated) of a police station, a hospital, a fire station or the like which is registered in advance. Here, the information on occurrence of the emergency situation (or emergency situation occurrence information) includes a predetermined number of snap shots before and/or after occurrence of the emergency situation with respect to an emergency situation occurrence time related to the emergency situation or a moving image for a predetermined time, emergency situation occurrence time information, and emergency situation occurrence reporting time information, an address of a location where the emergency situation occurs, emergency contact information of a location where the emergency situation occurs, and emergency contact information of an emergency personnel in a location where the emergency situation occurs.

In this case, the alarm verification device 100 generates a valid web page through which components included in the information on the occurrence of an emergency situation is identified only for a predetermined time (for example, one hour) and transmits an address of the generated web page to a terminal corresponding to an email or a phone number related to the server. Thereafter, a manager of the terminal corresponding to the email or the phone number related to the server receives the address of the web page transmitted from the alarm verification device 100 and accesses the web page by clicking (or selecting) the received address of the web page. Further, the manager of the terminal corresponding to the email or the phone number related to the server may identify components included in the information on the occurrence of an emergency situation through the accessed web page.

As described above, the alarm verification device 100 may directly transmit the information on the occurrence of an emergency situation to the server or transmit a web page address linking the information on the occurrence of an emergency situation to the server.

That is, as the determination result, when it is determined that emergency situation such as occurrence of a crime, occurrence of a patient, occurrence of a fire, or the like occurs, the alarm verification device 100 provides information on the occurrence of an emergency situation to the server which is registered in advance in the alarm verification device 100.

Further, the alarm verification device 100 generates an activity log (or activity log information) related to occurrence of the emergency situation and stores (or manages) the generated activity log. Here, the activity log includes a predetermined number of snap shots before and/or after occurrence of the emergency situation with respect to an emergency situation occurrence time related to the emergency situation or a moving image for a predetermined time, emergency situation occurrence time information, and emergency situation occurrence reporting time information.

For example, as a result, when it is determined that illegal intrusion to the first shop occurs in accordance with analysis of the motion of the person in the first image, the alarm verification device 100 provides the information on occurrence of an emergency situation for the illegal intrusion to a server of a police station which is registered in advance.

Further, the alarm verification device 100 generates a first activity log including moving images for five minutes before and/or after the time of determining the illegal intrusion in the first shop, emergency situation occurrence time information at the time of determining the illegal intrusion in the first shop, or time information when emergency situation occurrence information on the illegal intrusion is provided to the server of the police station (or emergency situation occurrence reporting time information) and stores the generated first activity log in the alarm verification device 100 (S340).

Further, as the determination result, when it is not appropriately determined whether the emergency situation occurs, the alarm verification device 100 transmits a verification request message to one or more terminals 200 corresponding to one or more emergency contacts included in the emergency contact network which is registered in advance. Here, the verification request message is a message for inquiring which actions should to be taken on the occurred emergency situation. The verification request message includes a predetermined number of snap shots before and/or after occurrence of the emergency situation with respect to an emergency situation occurrence time related to the emergency situation, emergency situation occurrence time information, address link information for checking a real-time image, real-time verification status information from one or more emergency contacts included in the emergency contact network, a response field, and information on remaining time to response.

That is, as the determination result, when it is not accurately determined whether it is the emergency situation (or when it is not 100% confirmed whether it is an emergency situation by analysis of the image and/or analysis of the sensing information), the alarm verification device 100 transmits the verification request message to one or more terminals 200 corresponding to one or more emergency contacts included in the emergency contact network which is registered in advance in the alarm verification device 100. In this case, the verification request message may have a format identified through a specific application provided from the alarm verification device 100 or may be a text message type, an e-mail type, or the like.

For example, as the determination result, when it is not accurately determined whether the motion of the person sensed in the first image is the illegal intrusion by analysis of the motion of the person in the first image, the alarm verification device 100 transmits the verification request message to first to fourth terminals corresponding to first to fourth emergency contacts which are registered in advance in the alarm verification device 100 in order to confirm whether the motion of the person sensed in the first image is the illegal intrusion (S350).

Thereafter, one or more terminals 200 receive the verification request message transmitted from the alarm verification device 100.

Further, one or more terminals 200 displays the received verification request message.

Figure 4:
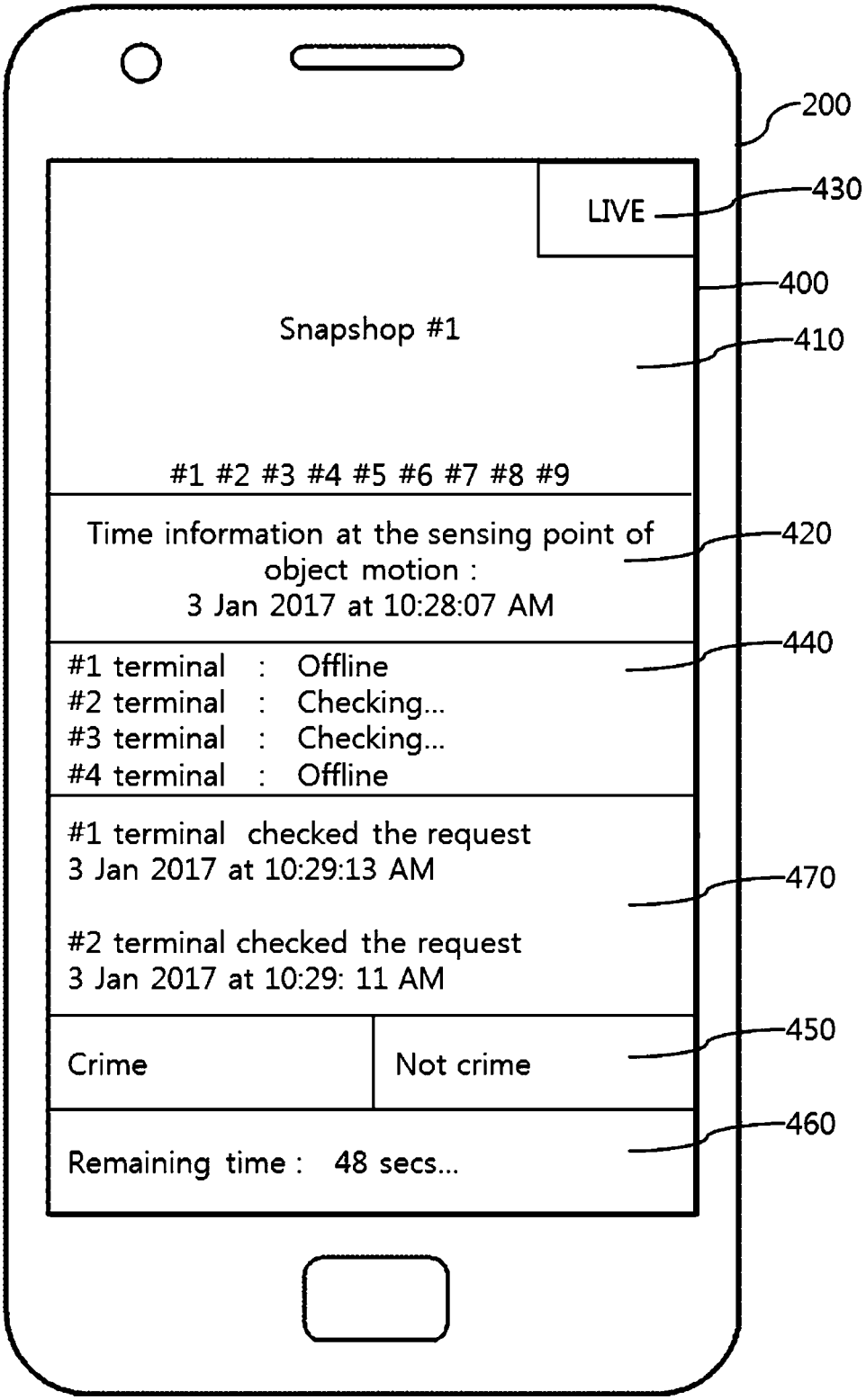
FIG. 4 is a view illustrating a verification request message according to an embodiment of the present invention.

For example, as illustrated in FIG. 4, the first terminal displays the verification request message 400 transmitted from the alarm verification device 100 through a dedicated application installed in the first terminal. Here, the verification request message 400 includes four snap shots before sensing the motion of the person which is identified every five seconds with respect to the motion sensing time of the person with respect to the motion of the sensed person, four snap shots after sensing the motion of the person, and a snap shot 410 at the time when the motion of the person is sensed, time information 420 when the motion of the person is sensed, first address link information 430 for checking a real-time image, real-time verification status information 440 from first to fourth terminals (for example, including information on whether the verification request message is received or whether the response message is transmitted), a response field 450 (for example, including that it is a crime or it is nota crime), information 460 on a remaining time to response, and a real-time activity log 470.

As another example, the second terminal displays a verification request message in the form of a text message transmitted from the alarm verification device 100 (S360).

Thereafter, at least one terminal 200 among the one or more terminals 200 transmits the response message to the alarm verification device 100 in response to the received verification request message. Here, the response message includes response information indicating whether it is an emergency situation (for example, including a crime/crime occurrence, occurrence of a patient, a fire/fire occurrence, not crime/no occurrence of a crime, no occurrence of a patient, or not fire/no occurrence of a fire).

In this case, one or more terminals 200 may not transmit the response message to the alarm verification device 100.

That is, one or more terminals 200 may not transmit the response message to the alarm verification device 100 because the received verification request message is not checked (or displayed) after receiving the verification request message transmitted from the alarm verification device 100 or may not transmit the response message to the alarm verification device 100 after displaying (or checking) the received verification request message.

As an example, when a crime field is selected from the response field 450 included in the verification request message 400 displayed in FIG. 4, the first terminal transmits a first response message including the selected crime field which is the first response information to the alarm verification device 100.

As another example, when afield indicating that it is not a crime is selected from the response field included in a displayed text message type verification request message, the second terminal transmits a second response message including the selected field indicating that it is not a crime to the alarm verification device 100 (S370).

Thereafter, after transmitting the verification request message to one or more terminals 200, the alarm verification device 100 checks whether a response message transmitted from at least one terminal 200 among one or more terminals 200 is received within a predetermined time.

That is, the alarm verification device 100 checks whether a response message transmitted from at least one terminal 200 among one or more terminals 200 is received within a predetermined time after transmitting the verification request message in order to smoothly perform a subsequent treatment for the occurred emergency situation.

For example, the alarm verification device 100 checks whether a response message transmitted from at least one terminal among the first to fourth terminals is received within 60 seconds which is a predetermined time after transmitting the verification request message to the first to fourth terminals (S380).

As a checking result, when the alarm verification device 100 does not receive the response message transmitted from at least one terminal 200 among the one or more terminals 200 within the predetermined time after transmitting the verification request message to one or more terminals 200, the alarm verification device 100 provides information on occurrence of the emergency situation to the server which is registered in advance according to a predetermined coping plan.

That is, as a checking result, after transmitting the verification request message to one or more terminals 200, when the alarm verification device 100 does not receive the response messages transmitted from any of the one or more terminals 200 within the predetermined time, the alarm verification device 100 provides information on occurrence of the emergency situation to the server which is registered in advance according to a coping plan set in advance in the alarm verification device 100.

Further, the alarm verification device 100 generates an activity log (or activity log information) related to occurrence of the emergency situation and stores (or manages) the generated activity log. Here, the activity log includes a predetermined number of snap shots before and/or after occurrence of the emergency situation with respect to an emergency situation occurrence time related to the emergency situation, a moving image for a predetermined time, emergency situation occurrence time information, verification request message transmitting time information, verification request message receiving time information for each of the one or more terminals corresponding to the emergency contact, information for each of the one or more terminals indicating whether the response message is transmitted from each of the one or more terminals, or emergency situation occurrence reporting time information.

As an example, as the checking result, when the alarm verification device 100 does not receive the response message transmitted from any of the first to fourth terminals within 60 seconds which is a predetermined time after transmitting the verification request message to the first to fourth terminals (or when the response message is not transmitted to the alarm verification device 100 from any of the first to fourth terminals within 60 seconds which is a predetermined time), the alarm verification device 100 provides information on occurrence of the emergency situation to the server of the police station in order to provide the information on occurrence of the emergency situation to the server of the police station which is registered in advance as a predetermined coping plan in response to failure to receive the response message from the terminals included in the emergency contact network.

Further, the alarm verification device 100 generates a second activity log including moving images for five minutes before and/or after occurrence of the emergency situation in the first shop, emergency situation occurrence time information on a time when the emergency situation occurs in the first shop, verification request message transmitting time information when the verification request message is transmitted to the first to fourth terminals, information on whether a response message is transmitted from the first to fourth terminals (for example, no response from all the first to fourth terminals), and time information on a time when the emergency situation occurrence information is provided to the server of the police station (or emergency situation occurrence reporting time information) and stores the generated second activity log in the alarm verification device 100 (S390).

Further, as the checking result, when the alarm verification device 100 receives the response message (or at least one response message) transmitted from at least one terminal 200 among one or more terminals 200 within a predetermined time after transmitting the verification request message to one or more terminals 200, the alarm verification device 100 performs a function corresponding to the response information included in the at least one received response message.

That is, as the checking result, when the alarm verification device 100 receives at least one response message transmitted from at least one terminal 200 among the one or more terminals 200 within a predetermined time after transmitting the verification request message to one or more terminals 200, the alarm verification device 100 determines whether information indicating the emergency situation (or response information includes emergency situation) is included in the at least one received response message.

As the determination result, when the information indicating that it is an emergency situation is included in the at least one received response message, the alarm verification device 100 provides information on occurrence of the emergency situation to the server which is registered in advance according to the predetermined coping plan.

Further, the alarm verification device 100 generates an activity log (or activity log information) related to occurrence of the emergency situation and stores (or manages) the generated activity log.

Further, as the determination result, when all the at least one received response message includes information indicating that it is not emergency situation (or the at least one received response message does not include information indicating that it is an emergency situation), the alarm verification device 100 generates the activity log (or the activity log information) and stores (or manages) the generated activity log without proceeding an additional procedure. Here, the activity log includes a predetermined number of snap shots before and/or after occurrence of the corresponding emergency situation with respect to an emergency situation occurrence time related to the emergency situation, a moving image for a predetermined time, emergency situation occurrence time information, verification request message transmitting time information, verification request message receiving time information for each of the one or more terminals corresponding to the emergency contact, information for one or more terminals indicating whether the response message is transmitted from each of the ono or more terminals, the response message from each of the one or more terminals, reception time information of the response message which is transmitted from each of the one or more terminals, or emergency situation occurrence reporting time information.

For example, when the alarm verification device 100 receives a first response message transmitted from the first terminal within 60 seconds which is a predetermined time after transmitting the verification request message to the first to fourth terminals, the alarm verification device 100 determines whether the received first response message includes information indicating that it is an emergency situation. Further, as the determination result, when the information indicating that it is an emergency situation is included in the first response message, the alarm verification device 100 provides the information on occurrence of an emergency situation to the server of the police station in order to provide the information on occurrence of an emergency situation to the server of the police station which is registered in advance in the alarm verification device 100 which is a predetermined coping plan corresponding to the information indicating that it is an emergency situation.

Further, the alarm verification device 100 generates a third activity log including moving images for five minutes before and/or after occurrence of the emergency situation in the first shop, emergency situation occurrence time information on a time when the emergency situation occurs in the first shop, verification request message transmitting time information when the verification request message is transmitted to the first to fourth terminals, information on whether response message from the first to fourth terminals is received, the first response message, response message receiving time information on when the first response message transmitted from the first terminal is received, and time information on when the emergency situation occurrence information is provided to the server of the police station (or emergency situation occurrence reporting time information) and stores the generated third activity log in the alarm verification device 100.

As another example, when the alarm verification device 100 receives a second response message transmitted from the second terminal within 60 seconds which is a predetermined time after transmitting the verification request message to the first to fourth terminals, the alarm verification device 100 determines whether the received second response message includes information indicating that it is an emergency situation. Further, as the determination result, when the second response message includes information indicating that it is not emergency situation, the alarm verification device 100 does not proceed additional procedure, but generates a fourth activity log including moving images for five minutes before and/or after occurrence of the emergency situation in the first shop, emergency situation occurrence time information on a time when the emergency situation occurs in the first shop, verification request message transmitting time information when the verification request message is transmitted to the first to fourth terminals, information on whether a response message from the first to fourth terminals is received, the second response message, and response message receiving time information when the second response message transmitted from the second terminal is received and stores the generated fourth activity log in the alarm verification device 100 (S400).

According to the exemplary embodiment of the present invention, as described above, when occurrence of an emergency situation such as a crime or a fire is uncertain based on information relating to a predetermined alarm which is generated, a verification request message is transmitted to an emergency contact network which is registered in advance and when information on occurrence of an emergency situation is included in a response message thereof, information on occurrence of an emergency situation is provided to a server which is registered in advance so that payment of penalty for erroneously reporting for occurrence of an emergency situation may be avoided.

Further, according to the exemplary embodiment of the present invention, as described above, when a response message is not transmitted from one or more contact numbers included in an emergency contact network in response to a verification request message which is transmitted to the emergency contact network, information on occurrence of a crime, occurrence of a patient, occurrence of a fire, or the like is provided to a server which is registered in advance, according to a predetermined coping plan, so that it is possible to perform prompt action in response to the occurrence of an emergency situation, improve convenience in use, and improve reliability of the entire system.

Furthermore, according to the exemplary embodiment of the present invention, as described above, when an emergency situation occurs, an activity log including a verification request message which is transmitted to an emergency contact network, information on whether a response message thereof is received, and time information is managed so that it is possible to clarify responsibility for a report for occurrence of an emergency situation.

Changes or modifications of the above description may be made by those skilled in the art without departing from the spirit and scope of the present invention. Accordingly, the exemplary embodiments disclosed herein are not intended to limit but describe the technical spirit of the present invention and the scope of the technical spirit of the present invention is not restricted by the exemplary embodiments. The protection scope of the present invention should be interpreted based on the following appended claims and it should be appreciated that all technical spirits included within a range equivalent thereto are included in the protection scope of the present invention.

According to the present invention, when occurrence of an emergency situation such as a crime or a fire is uncertain based on information according to whether a predetermined alarm is generated, a verification request message is transmitted to an emergency contact network which is registered in advance and when information on occurrence of an emergency situation is included in a response message thereof, information on occurrence of an emergency situation is provided to a server of a police station, a hospital, a fire station, or the like which is registered in advance so that payment of penalty for erroneously reporting for occurrence of an emergency situation may be avoided, a prompt treatment according to the emergency situation occurrence is performed, and reliability of the entire system is improved. Therefore, the present invention may be widely used in a network camera field, an object sensing field, an image field, a server field, a security surveillance field.

What is claimed is:

1. An alarm verification method for ensuring reliability for an alarm, the method comprising:

transmitting a verification request message, by a communication unit, to two or more terminals corresponding to one or more emergency contacts included in an emergency contact network which is registered in advance, if a situation is not accurately determined by a control unit whether it is an emergency situation based on at least one of image information obtained by a photographing unit and sensing information sensed by a sensor unit when a predetermined alarm is generated;

checking whether at least one response message is received from at least one terminal among the two or more terminals within a predetermined time after transmitting the verification request message to the two or more terminals, by the control unit, wherein the verification request message includes real-time verification status information from the one or more emergency contacts included in the emergency contact network; and performing a function by the control unit corresponding to response information included in the at least one response message received from the at least one terminal among the two or more terminals within the predetermined time after transmitting the verification request message to the two or more terminals, wherein the performing of the function by the control unit corresponding to the response information, includes:

determining whether information indicating that the situation is the emergency situation is included in the at least one response message received from the at least one terminal among the two or more terminals;

providing information on occurrence of the emergency situation to a server which is registered in advance, when information indicating that the situation is an emergency situation is included in the at least one response message received as a determination result;

ending the process without proceeding an additional procedure, when a second response message received from one terminal among the two or more terminals indicates that the situation is not the emergency situation follows a first response message received from a different terminal among the two or more terminals that indicated the situation is the emergency situation and providing information on occurrence of the emergency situation from the first response message to a server which is registered in advance;

generating a third activity log related to the occurrence of the emergency situation as reported by the first response message received;

storing the generated third activity log in a storage unit;

generating a fourth activity log related to the second message received; and storing the generated fourth activity log in the storage unit.

2. The alarm verification method of claim 1, wherein the verification request message includes at least one of a predetermined number of snap shots before and/or after occurrence of the situation with respect to a situation occurrence time related to the emergency situation, the situation occurrence time information, an address link information for checking a real-time image, a response field, and information on remaining time to response.

3. The alarm verification method of claim 1, further comprising:

providing information on occurrence of the situation to the server which is registered in advance by the control unit, when the at least one response message transmitted from at least one terminal among the two or more terminals is not received within the predetermined time after transmitting the verification request message to the one or more terminals as the checking result;

generating a first activity log related to occurrence of the situation, by the control unit; and storing the generated first activity log in the storage unit, by the control unit.

4. The alarm verification method of claim 3, wherein the first activity log includes at least one of a predetermined number of snap shots before and/or after occurrence of the situation with respect to a situation occurrence time related to the situation, a moving image for a predetermined time, a situation occurrence time information, a verification request message transmitting time information, a verification request message receiving time information for each of the one or more terminals corresponding to the emergency contact, information for each of the one or more terminals indicating whether the response message is transmitted from each of the one or more terminals, and a situation occurrence reporting time information.

5. The alarm verification method of claim 1, wherein the performing of the function corresponding to the response information, includes:

determining whether information indicating that the situation is the emergency situation is included in the at least one response message received from the at least one terminal among the two or more terminals;

providing information on occurrence of the emergency situation to a server which is registered in advance, when information indicating that the situation is an emergency situation is included in the at least one response message received as a determination result;

ending the process without proceeding an additional procedure, when information indicating that the situation is not the emergency situation is included in all of the at least one response message received as the determination result;

generating a second activity log related to the occurrence of the emergency situation; and storing the generated second activity log in the storage unit.

6. The alarm verification method of claim 5, wherein the second activity log includes at least one of the predetermined number of snap shots before and/or after the occurrence of the emergency situation with respect to the emergency situation occurrence time related to the emergency situation, a moving image for a predetermined time, the emergency situation occurrence time information, the verification request message transmitting time information, the verification request message receiving time information for each of the two or more terminals corresponding to the emergency contact, the information for each of the one or more terminals indicating whether the response message is transmitted from each of the one or more terminals, the response message from each of the one or more terminals, reception time information of the response message which is transmitted from each of the one or more terminals, and the emergency situation occurrence reporting time information.

7. The alarm verification method of claim 1, further comprising:

checking whether the predetermined alarm is generated based on at least one information among the image information obtained by the photographing unit and the sensing information sensed by the sensor unit, by the control unit;

determining whether at least one emergency situation among a crime, a patient, and a fire occurs, by the control unit, when the predetermined alarm is generated;

providing information on occurrence of the emergency situation to a server which is registered in advance, by the control unit when it is determined that the emergency situation occurs;

generating the third activity log related to the occurrence of the emergency situation, by the control unit; and storing the generated third activity log in the storage unit, by the control unit.

8. The alarm verification method of claim 7, wherein the third activity log includes at least one of a predetermined number of snap shots before and/or after the occurrence of the emergency situation with respect to the emergency situation occurrence time related to the emergency situation, a moving image for a predetermined time, an emergency situation occurrence time information, and an emergency situation occurrence reporting time information.

9. The alarm verification method of claim 1, wherein the third activity log includes a set of moving images for five minutes before and/or after occurrence of the emergency situation, emergency situation occurrence time information on a time when the emergency situation occurs, a verification request message transmitting time information when the verification request message is transmitted to the two or more terminals, information on whether response message from at least one terminal among the two or more terminals is received, the first response message, a response message receiving time information on when the first response message transmitted from the first terminal is received, and time information on when the emergency situation occurrence information is provided to the server that is registered in advance.

10. The alarm verification method of claim 1, wherein the fourth activity log includes a set of moving images for five minutes before and/or after occurrence of the situation, an emergency situation occurrence time information on a time when the situation occurs, a verification request message transmitting time information when the verification request message is transmitted to the two or more terminals, information on whether a response message from the at least one terminal among the two or more terminals is received, the second response message, and the response message receiving time information when the second response message transmitted from the second terminal is received.

11. An alarm verification system for ensuring reliability for an alarm, the system comprising:

a photographing unit which obtains image information;

a sensor unit which senses a motion of an object and an on/off state of a door;

a communication unit which, if a situation is not accurately determined whether it is an emergency situation based on at least one of image information obtained by the photographing unit and sensing information sensed by the sensor unit when a predetermined alarm is generated, transmits a verification request message to two or more terminals corresponding to one or more emergency contacts included in an emergency contact network which is registered in advance; and a control unit which, when at least one response message transmitted from at least one terminal among the two or more terminals is received within a predetermined time after transmitting the verification request message to the two or more terminals, performs a function corresponding to response information included in the least one response message received, wherein the verification request message includes real-time verification status information from the one or more emergency contacts included in the emergency contact network, wherein the alarm verification system receives two or more response messages sent from the two or more terminals within the predetermined time, and wherein the alarm verification system ends the process without proceeding to an additional procedure when a second response message received from one terminal among the two or more terminals indicating the situation is not the emergency situation follows a first response message received from a different terminal among the two or more terminals indicating the situation is the emergency situation, the alarm verification system providing information on occurrence of the emergency situation from the first response message to a server which is registered in advance, a third activity log generated that contains information from the first response message and stored in a storage unit and a fourth activity log generated that contains information from the second response message and stored in the storage unit.

12. The alarm verification system of claim 11, wherein the control unit provides information on occurrence of the emergency situation to the server which is registered in advance, when information indicating that it is an emergency situation is included in the received at least one response message, generates a second activity log related to the occurrence of the emergency situation, and stores the generated second activity log in the storage unit.

13. The alarm verification system of claim 11, wherein the control unit generates the third activity log related to the first response message, stores the generated third activity log in the storage unit, generates the fourth activity log related to the second response message, and stores the generated fourth activity log in a storage unit.

* * * * *